US005895330A

United States Patent [19]

Reilly, Jr.

[11] Patent Number: 5,895,330

[45] **Date of Patent: *Apr. 20, 1999**

[54] MODIFIED SPORTS GOAL FOR IMPROVING SHOOTING ACCURACY

[76] Inventor: Francis J. Reilly, Jr., Nine Flintlock Rd., Lexington, Mass. 02173

[ * ] Notice: This patent issued on a continued prosecution application filed under 37 CFR 1.53(d), and is subject to the twenty year patent term provisions of 35 U.S.C. 154(a)(2).

[21] Appl. No.: 08/781,416

[22] Filed: Jan. 10, 1997

[51] Int. Cl.[6] ..... A63B 69/00

[52] U.S. Cl. ..... 473/446; 273/127 B; 273/400; 473/478

[58] Field of Search ..... 473/446, 478; 273/400, 127 B

[56] References Cited

U.S. PATENT DOCUMENTS

| | | | |
|---|---|---|---|
| 3,840,228 | 10/1974 | Greaney | 273/1 B |
| 3,856,298 | 12/1974 | Frantti | 273/1 B |
| 3,887,181 | 6/1975 | Samaras | 273/1 B |
| 3,944,223 | 3/1976 | Bromwell | 473/446 |
| 4,160,549 | 7/1979 | Simpson | 273/29 A |
| 4,407,507 | 10/1983 | Caruso et al. | 273/400 |
| 4,826,164 | 5/1989 | Butcher | 273/400 |
| 4,921,257 | 5/1990 | Heller | 273/401 |
| 4,948,147 | 8/1990 | Pallanca | 473/478 |
| 5,181,725 | 1/1993 | Leras et al. | 473/446 |
| 5,238,243 | 8/1993 | Grispi | 473/446 |
| 5,503,402 | 4/1996 | Moss, Jr. | 473/446 |

FOREIGN PATENT DOCUMENTS

| | | | |
|---|---|---|---|
| 2446465 | 9/1980 | France | 273/400 |
| 2307350 | 8/1974 | Germany | 273/127 B |

*Primary Examiner*—Mark S. Graham
*Attorney, Agent, or Firm*—Pearson & Pearson

[57] ABSTRACT

A modified sports goal is adapted for training a sports player to direct objects into preferred target areas. A modified goalpost frame is formed in the shape of a preferred target area of a standard sports goal. A net is coupled to the goalpost frame. The goalpost and net capture objects, such as hockey pucks, directed into the preferred target area, and allow misdirected objects which otherwise would have been captured by the standard sports goal to pass thereby. In this manner, a participant is rewarded with the feeling of achieving a goal only if the object enters the target areas. Otherwise, the object passes by the goal. This goal reduces the need for goaltenders during practice sessions, mitigating the possibility of goaltender injury and improving the shooter's ability to develop skills.

23 Claims, 3 Drawing Sheets

MODIFIED SPORTS GOAL FOR IMPROVING SHOOTING ACCURACY

BACKGROUND

Development of shooting skills is a key element for success in goal-oriented sports. Factors which contribute to an effective shot include accuracy, speed, ability to strike target areas, and quickness to release the shot. Developing these skills in a practice session increases the chance of scoring a goal during actual competition.

In the sport of hockey for example, the areas of the hockey goal proximal to both goal posts, along the ice, and between the goaltender's legs are considered target areas. In these regions, it is generally more difficult for the goaltender to react to an incoming hockey puck. It therefore follows that shots directed into these regions have a greater likelihood of entering the goal.

In the most common training method, a live goaltender is used to oppose the shot. However, the goaltender's movements are unpredictable and often times inconsistent, especially in an amateur setting. In addition, the skill levels of participants, referred to herein as "skaters" or "shooters", and goaltenders attending a practice session may vary. Since shooting skill development requires a consistent target, live goaltenders can sometimes be unattractive for shooting practice.

Furthermore, goaltenders may be unavailable during a practice session or during a pickup session due to illness, injury, or involvement in other drills. To overcome this, skaters sometimes turn the goal on its side or on its face to provide a smaller goal area at which to shoot. This makes the act of scoring a goal more challenging but does not train the shooters to strike preferred target areas of the goal.

Others employ wood or plastic blockers as shown in U.S. Pat. Nos. 3,840,228, 3,856,298, and 3,887,181. These devices block the shots directed to the low-probability regions of the goal, in other words, those regions of the goal which would generally be covered by the goaltenders. These blocking devices are generally complicated, heavy and awkward to install. Furthermore, a shooter who strikes the dummy goaltender is falsely rewarded with the feeling of having a "goal" when the blocker stops the puck even though the puck was directed to a non-preferred region of the goal.

FIG. 1 is a perspective front view of a standard prior art sports goal 20. The goal 20 comprises left and right goal posts 22A, 22B, adapted to rest normal to the playing surface 34, a crossbar 24 perpendicular to each of the goalposts 22A, 22B and parallel to the playing surface 34, and a net 26. The net 26 captures or otherwise stops a puck directed therein when a goal is scored. A rear support bar 30, and rear support posts 28A and 28B provide rigidity to the goal, allowing it to rest on the playing surface 34 as a rigid structure.

SUMMARY OF THE INVENTION

The present invention is directed to a sports goal shaped to stop and/or capture only those shots directed to the target areas of a standard goal. In this manner, the shooter is rewarded with the feeling of achieving a goal only if the puck strikes the target areas. Otherwise, the puck passes by the goal. If a shot is directed to that portion of a standard goal which is typically guarded by a goaltender, then the shooter is not falsely rewarded by stoppage of the puck as in the prior art trainers. The invention reduces the need for goaltenders during practice sessions, mitigating the possibility of goaltender injury and improving the shooter's ability to develop skills.

In a first preferred embodiment, the present invention comprises a modified sports goal for training a sports player to project objects into a preferred target area of a standard sports goal. A modified goalpost frame is formed in the shape of a preferred target area of the standard sports goal. A net is coupled to the modified goalpost frame. The modified goalpost and net capture objects directed into the preferred target area and allow misdirected objects which otherwise would have been captured by the standard sports goal to pass thereby.

In a second preferred embodiment, the sports goal comprises a hockey goal. The goalpost frame comprises two vertical posts of standard height, for example 4 ft., and of standard distance apart, for example 6 ft. The frame further comprises a crossbar modified to encompass the preferred target areas of a standard goal. The target areas preferably include the region proximal to the goalposts, the region proximal to the playing surface between the goalposts, and the region in the center of the goal between a goaltender's legs.

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF PREFERRED EMBODIMENTS

Figure 2:
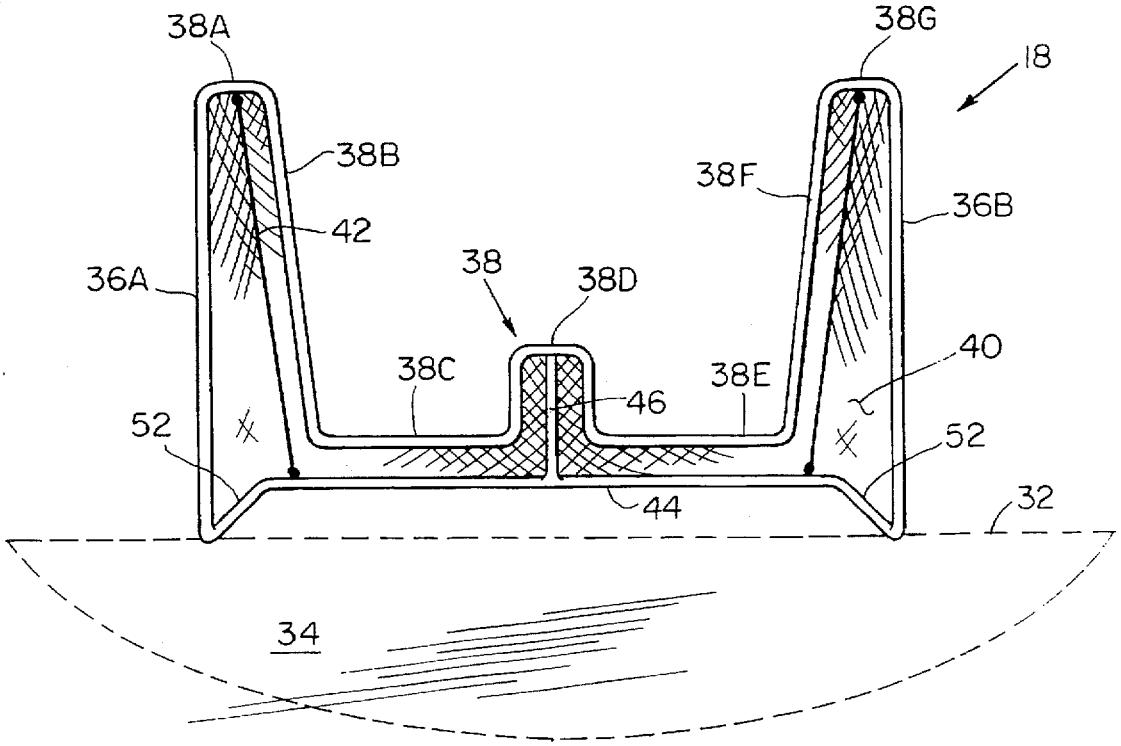
FIG. 2 is a front perspective view of a modified hockey goal in accordance with the present invention.

FIG. 2 is a front view of a modified sports goal in accordance with the present invention. Specifically, the goal illustrated is an ice hockey goal. Note that although the present invention is described with reference to modified ice hockey goals, the concepts of the present invention apply equally as well to other goal-oriented sports including soccer, lacrosse, and field hockey.

The modified hockey goal 18 illustrated in FIG. 2 includes a left goalpost 36A, a right goalpost 36B, and a crossbar 38. The goalposts 36A, 36B and the crossbar 38 form a plane which intersects the playing surface 34 at a goal line 32. A hockey puck or ball passing through this plane enters the goal and is stopped and/or captured by a net 40.

Figure 1:
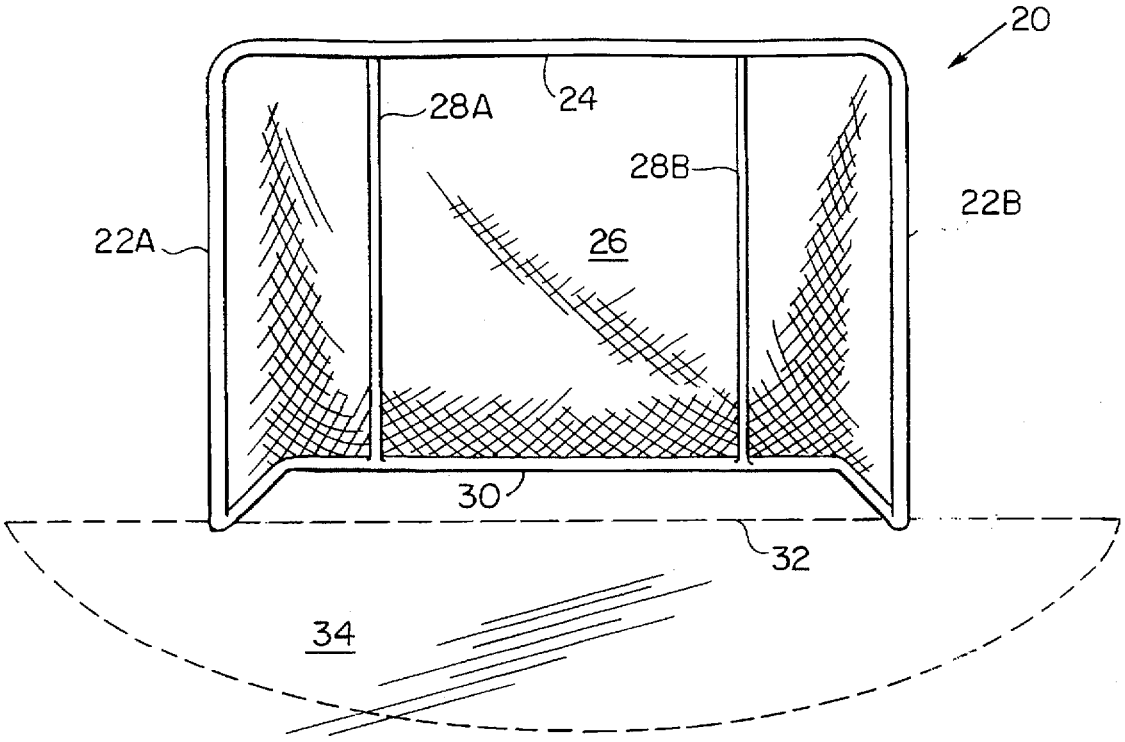
FIG. 1 Prior Art
FIG. 1 is a front perspective view of a standard hockey goal in accordance with the prior art.

The crossbar 38 of the present invention is shaped so as to encompass preferred target areas of the standard sports goal 20 shown in prior art FIG. 1. For example, the region of the goal of FIG. 2 bordered by goalpost 36A and crossbar sections 38A and 38B defines a target area proximal to the left goalpost 36A. Similarly, the following regions define target areas: the region proximal to the right goalpost 36B defined by the right goalpost 36B and the crossbar sections 38F and 38G, the region between the goalposts 36A, 36B and along the playing surface 34 defined by the goal line 32 and crossbar sections 38C and 38E; the region between the goaltender's legs beneath crossbar section 38D. As described above, these target areas are sought after by shooters as areas of high scoring probability. The regions can be made wider for beginners and narrower for expert sharp-shooters. In a preferred embodiment suitable for general use, the target areas proximal to the goalpost are 4 ft. high by 6 in. wide at the top tapered to 9 in. wide at the base, the target area between the legs is 20 in. high by 8 in. wide, and the target area along the playing surface is 10 in. high.

A rear support bar 44 and side support bars 52 stop pucks traveling along the playing surface and together with a support post 46 form a rigid goal structure. Elastic cords 42 stretch between the support bar 44 at the base of the goal and crossbar sections 38A, 38G as shown to pull the net taut thereby preventing the net 40 from interfering with the face of the goal. Support posts may also be used for this purpose.

Figure 3:
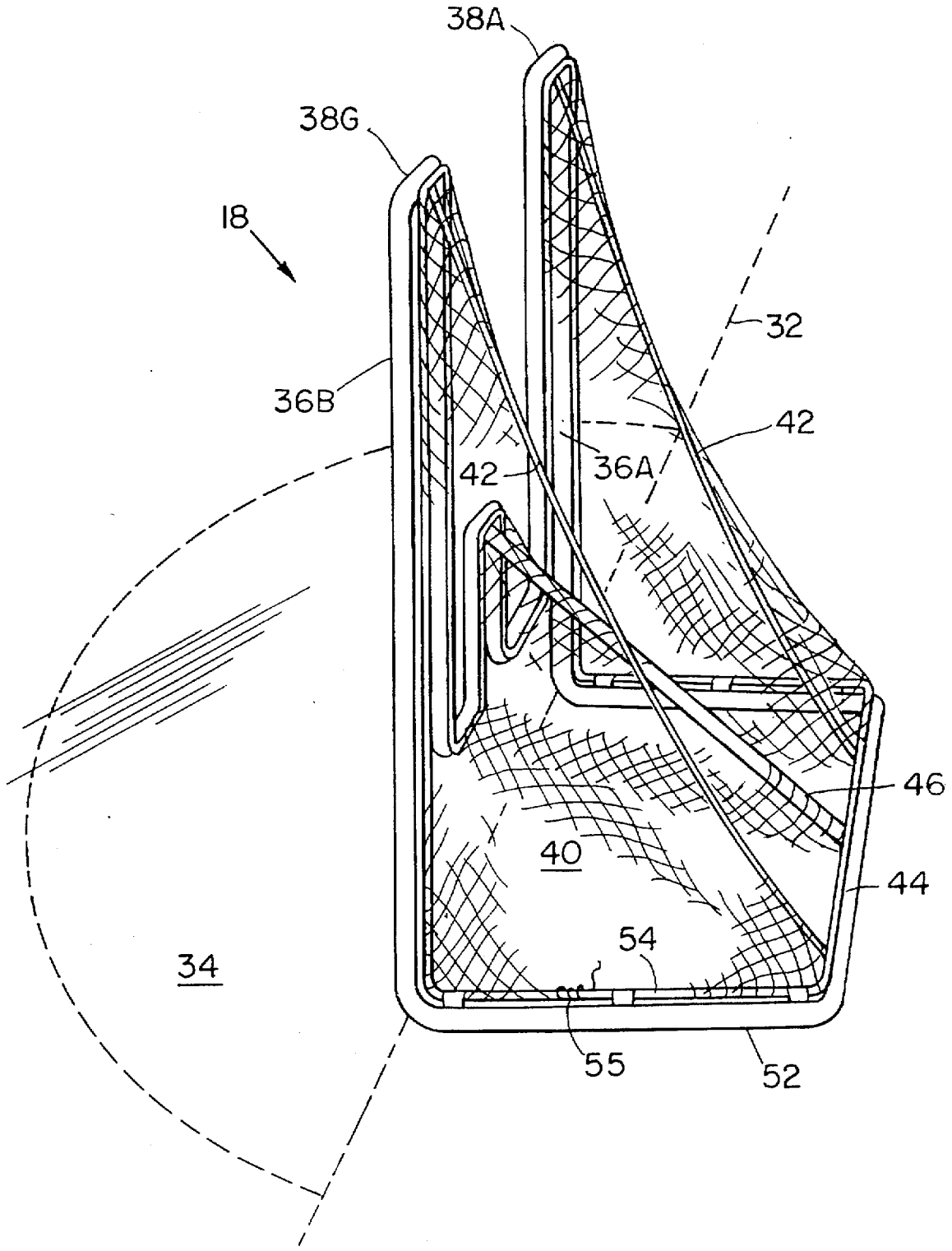
FIG. 3 is a side perspective view of a modified hockey goal in accordance with the present invention.

FIG. 3 is a side perspective view of the modified goal of the present invention. The operation of the elastic cords 42 supporting the net 40 is clearly visible in this view. It can also be seen that the rear support bar 44 in combination with side support bar 52, support pole 46, goalposts 36A, 36B, and crossbar 38A, 38G are interrelated so as to give triangulation and therefore structure to the goal 18. Additional support posts may be added between the goalposts 36A, 36B and the side support bars 52 and between the rear support bar 44 and side support bars 52 to further strengthen the structure of the goal 18.

A net coupling bar 54 runs parallel to and behind the goalposts 36A, 36B and crossbar 38, and parallel to and above the rear support bar 44 and side support bars 52. The net is woven onto the net coupling bar 54 using a nylon cord 55. Other coupling means may be used to fasten the net 40 to the goalposts, for example twist ties, clamps, and the like.

Figure 4:
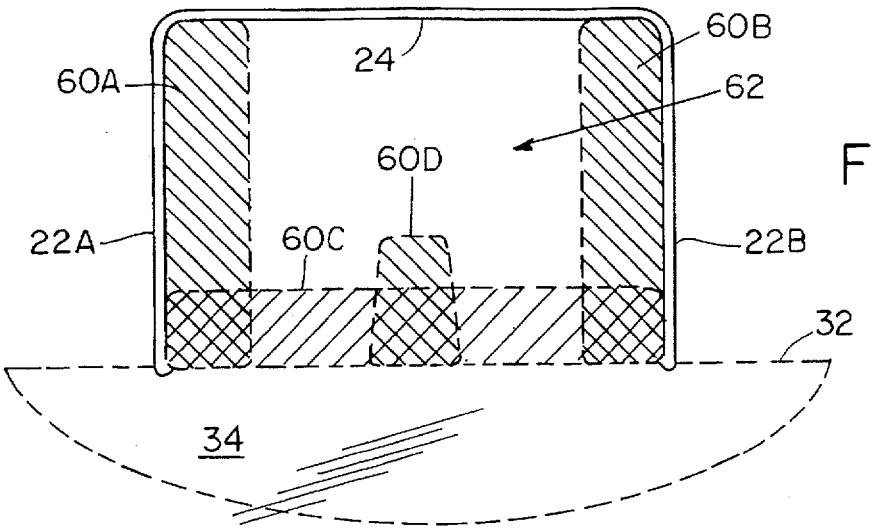
FIG. 4 illustrates preferred target regions for a standard hockey goal in accordance with the present invention.

FIG. 4 illustrates preferred target regions in accordance with the present invention. The goal area of a standard sports goal is defined by goalposts 22A, 22B and crossbar 24. As described above, preferred target regions within the standard hockey goal include the regions proximal to the goalposts 60A, 60B, the region along the playing surface 60C, and the region between the goaltender's legs 60D. In the present invention, these preferred regions are bounded by goalposts 36, 38 and a net 40 as shown in FIGS. 2 and 3.

When a puck is directed into these preferred regions 60 the puck is stopped and/or captured by the net 40, and the player is rewarded with the feeling of scoring a goal. Any pucks directed into a region 62 not defined as a preferred target region and therefore not bounded by the goalposts pass through the plane of the goal outside of the modified goal area and are therefore not stopped or captured by the net. The puck therefore passes through the plane between regions 60A and 60B and bounces off the boards. Therefore, a player shooting into this low-probability zone is not rewarded with the feeling of scoring a goal. This is in contrast with the prior art training systems described above wherein any pucks which strike the low-probability zone covered by the blocker board are stopped even though the shot would likely not have resulted in a goal.

Figure 5A:
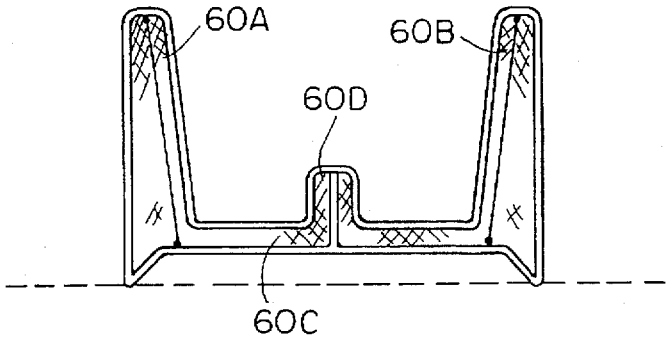
FIGS. 5A, 5B, and 5C are schematic illustrations of alternative goalpost configurations in accordance with the present invention.
Figure 5B:
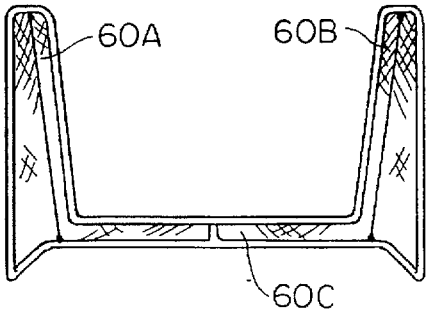
Figure 5C:
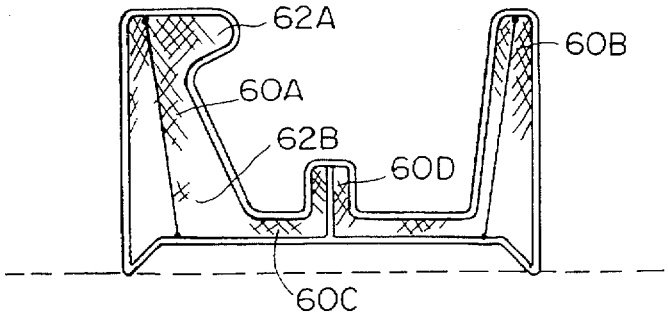

FIGS. 5A, 5B, and 5C illustrate alternative goalpost configurations in accordance with the present invention. In FIG. 5A, the target regions along the goalposts 60A, 60B, along the playing surface 60C, and between the goaltender's legs 60D are encompassed by the goalposts and modified crossbar. In FIG. 5B, only those regions proximal to the goalposts 60A, 60B and along the ice 60C are included as target regions. Such a net could be employed during training for shooting against a goaltender known to keep his legs together when making saves.

FIG. 5C illustrates a goal of the present invention having non-symmetrical regions. In this embodiment, region 60A is wider than region 60B. Region 60A includes wide target regions near the top 62A and bottom 62B portions of the goal. Region 60B is narrower in this illustration. This embodiment would apply to training to shoot against a right-handed goaltender using a blocker on his right arm to stop pucks entering the right side of the goal near region 60A, and a catching glove on his left arm to protect the left side of the goal near region 60B (note that "left" and "right" for purposes of this paragraph are taken from a goaltender's perspective). A goaltender is generally strong on the glove side, so the target region 60B corresponding to the glove is relatively small. Likewise, a goaltender is relatively weak on the blocker side, so the target region 60A corresponding to the blocker is relatively large. On the blocker side, the goalie is perhaps beatable over his right shoulder in region 62A and under the arm in region 62B, which is good reason for widening these target areas. Many configurations are conceivable, including configurations which modify the shape of the vertical goalposts 36A, 36B in addition to or to the exclusion of a modified crossbar 38.

In a preferred embodiment of the present invention well-suited for ice hockey, the goalpost frame comprises steel pipe welded to form a rigid structure and the net comprises nylon mesh. In alternative embodiments, the frame may comprise materials including plastic tubing, aluminum, wood, graphite, carbon. The frame may be formed in a single piece or can be adapted to snap or glue together or otherwise may include hinges and pins to create a frame which can be folded flat. The net preferably comprises nylon mesh but may include chicken wire, plastic fencing, plywood, or other means suitable for stopping objects such as pucks or balls directed into the goal. Goalpost placement pins may be added to prevent inadvertent movement of the goal when struck.

While this invention has been particularly shown and described with references to preferred embodiments thereof, it will be understood by those skilled in the art that various changes in form and details may be made therein without departing from the spirit and scope of the invention as defined by the appended claims.

I claim:

1. A sports goal for improving shooting accuracy comprising:

a frame having a horizontal section and a vertical section;

said horizontal section comprises members arranged to form a base for said goal;

said vertical section comprises a left portion connected to a first end of said horizontal section and a right portion connected to a second-end of said horizontal section;

said left portion comprises an area formed by a spaced apart first vertical member and second vertical member, an upper end of said first vertical member connected to an upper end of said second vertical member by a first cross-member;

said right portion comprises an area formed by a spaced apart third vertical member and fourth vertical member, an upper end of said third vertical member connected to an upper end of said fourth-vertical member by a second cross-member;

a lower horizontal member spaced a predetermined distance above the level of said horizontal section connected to said second vertical member of said left portion at said first end and connected to said third vertical member of said right portion at said second end;

a support member having a first end attached to said lower horizontal member and a second end attached to a middle one of said members of said horizontal section; and means attached around the periphery of said vertical section and horizontal section for forming a pocket enclosure rearwardly of said vertical section.

2. The sports goal as recited in claim 1 wherein said sports goal comprises a first means having a first end attached to said first cross-member of said left portion and a second end attached to said middle one of said members of said horizontal section for holding said pocket enclosure to form a portion of said pocket.

3. The sports goal as recited in claim 1 wherein said sports goal comprises a second means having a first end attached to said second cross-member of said right portion and a second end attached to said middle one of said members of said horizontal section for holding said pocket enclosure to form a portion of said pocket.

4. The sports goal as recited in claim 1 wherein said horizontal section and said vertical section are formed from materials selected from a group comprising steel pipe, plastic tubing, aluminum, wood, graphite and carbon.

5. The sports goal as recited in claim 1 wherein said members of said horizontal section form a U-shaped base.

6. The sports goal as recited in claim 1 wherein said forming means comprises a nylon mesh net.

7. The sports goal as recited in claim 1 wherein the members of said horizontal section and said vertical section comprise plastic tubing adapted to snap or glue together.

8. The sports goal as recited in claim 1 wherein said pocket enclosure catches a device shot at said sports goal including a hockey puck.

9. A sports goal for improving shooting accuracy comprising:

a frame having a horizontal section and a vertical section;

said horizontal section comprises members arranged to form a base for said goal;

said vertical section comprises a left portion connected to a first end of said horizontal section and a right portion connected to a second end of said horizontal section;

said left portion comprises an area formed by a spaced apart first vertical member and second vertical member, an upper end of said first vertical member connected to an upper end of said second vertical member by a first cross-member;

said right portion comprises an area formed by spaced apart third vertical member and fourth vertical member, an upper end of said third vertical member connected to an upper end of said fourth vertical member by a second cross-member;

a lower horizontal member spaced a predetermined distance above the level of said horizontal section connected to said second vertical member of said left portion at said first end and connected to said third vertical member of said right portion at said second end;

said lower horizontal member further comprises a center portion formed by a spaced apart fifth vertical member and sixth vertical member orthogonally attached to said lower horizontal member, an upper end of said fifth vertical member connected to an upper end of said sixth vertical member by a third cross-member;

said fifth vertical member and said sixth vertical member extend vertically a predetermined shorter distance than said left portion and said right portion of said vertical section;

a support member having a first end attached to said third cross-member of said vertical section and a second end attached to a middle one of said members of said horizontal section; and means attached around the periphery of said vertical section and horizontal section for forming a pocket enclosure rearwardly of said vertical section.

10. The sports goal as recited in claim 9 wherein said sports goal comprises a first means-having a first end attached to said first cross-member of said left portion and a second end attached to said middle one of said members of said horizontal section for holding said pocket enclosure to form a portion of said pocket.

11. The sports goal as recited in claim 9 wherein said sports goal comprises a second means having a first end attached to said second cross-member of said right portion and a second end attached to said middle one of said members of said horizontal section for holding said pocket enclosure to form a portion of said pocket.

12. The sports goal as recited in claim 9 wherein said horizontal section and said vertical section are formed from materials selected from a group comprising steel pipe, plastic tubing, aluminum, wood, graphite and carbon.

13. The sports goal as recited in claim 9 wherein said second vertical member of said left portion extends from said lower horizontal member toward said first vertical member and then turns approximately ninety degrees for a predetermined distance and curving to meet an end of said first cross-member.

14. The sports goal as recited in claim 9 wherein said members of said horizontal section form a U-shaped base.

15. The sports goal as recited in claim 9 wherein said pocket enclosure catches a forming means comprises a nylon mesh net.

16. The sports goal as recited in claim 9 wherein the members of said horizontal section and said vertical sections comprise plastic tubing adapted to snap or glue together.

17. The sports goal as recited in claim 9 wherein said pocket enclosure catches a device shot at said sports goal including a hockey puck.

18. A method of providing a sports goal for improving shooting accuracy comprising the steps of:

providing a frame having a horizontal section and a vertical section;

arranging members of said horizontal section to form a base for said goal;

connecting a left portion of said vertical section to a first end of said horizontal section and connecting a right portion to a second end of said horizontal section;

forming said left portion by a spaced apart first vertical member and second vertical member, an upper end of said first vertical member connected to an upper end of said second vertical member by a first cross-member;

forming said right portion by a spaced apart third vertical member and fourth vertical member, an upper end of said third vertical member connected to an upper end of said second vertical member by a second cross-member;

providing a lower horizontal member spaced a predetermined distance above the level of said horizontal section connected to said second vertical member of said left portion at said first end and connected to said third vertical member of said right portion at said second end;

providing a support member having a first end attached to said lower horizontal member and a second end attached to a middle one of said members of said horizontal section; and attaching means around the periphery of said vertical section and horizontal section to form a pocket enclosure rearwardly of said vertical section.

19. The method as recited in claim 18 wherein said step of attaching means around the periphery of said sports goal comprises the step of attaching a nylon mesh net.

20. The method as recited in claim 18 wherein said step of attaching means around the periphery of said sports goal comprises the step of catching a hockey puck shot at said goal.

21. A method of providing a sports goal for improving shooting accuracy comprising the steps of:

providing a frame having a horizontal section and a vertical section;

arranging members of said horizontal section to form a base for said goal;

connecting a left portion of said vertical section to a first end of said horizontal section and connecting a right portion to a second end of said horizontal section;

forming said left portion by a spaced apart first vertical member and second vertical member, an upper end of said first vertical member connected to an upper end of said second vertical member by a first cross-member;

forming said right portion by a spaced apart third vertical member and fourth vertical member, an upper end of said first vertical member connected to an upper end of said second vertical member by a second cross-member;

providing a lower horizontal member spaced a predetermined distance above the level of said horizontal section having said first end connected to said second vertical member of said left portion at said first end and connected to said third vertical member of said right portion at said second end;

forming a center portion in said lower horizontal member by a spaced apart fifth vertical member and sixth vertical member both orthogonally attached to said lower horizontal member, an upper end of said fifth vertical member connected to an upper end of said sixth vertical member by a third cross-member;

extending said fifth vertical member and said sixth vertical member vertically a predetermined shorter distance than said left portion and said right portion of said vertical section;

providing a support member having a first end attached to said third cross-member of said vertical section and a second end attached to a middle one of said members of said horizontal section; and attaching means around the periphery of said vertical section and horizontal section to form a pocket enclosure rearwardly of said vertical section.

22. The method as recited in claim 21 wherein said step of attaching means around the periphery of said sports goal comprises the step of providing a nylon mesh net.

23. The method as recited in claim 21 wherein said step of attaching means around the periphery of said sport goal comprises the step of catching a hockey puck shot at said goal.

* * * * *